US006896057B2

(12) United States Patent
Metcalfe

(10) Patent No.: US 6,896,057 B2
(45) Date of Patent: May 24, 2005

(54) CONNECTOR FOR EXPANDABLE WELL SCREEN

(75) Inventor: Paul David Metcalfe, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/827,228

(22) Filed: Apr. 19, 2004

(65) Prior Publication Data

US 2004/0194968 A1 Oct. 7, 2004

Related U.S. Application Data

(63) Continuation of application No. 09/762,410, filed as application No. PCT/GB99/02605 on Aug. 9, 1999, now Pat. No. 6,722,443.

(30) Foreign Application Priority Data

Aug. 8, 1998 (GB) ..... 9817246

(51) Int. Cl.[7] ..... E21B 29/00; E21B 17/02; E21B 43/08; F16L 21/00

(52) U.S. Cl. ..... 166/277; 166/207; 166/235; 166/242.2; 403/277; 403/278; 285/53; 285/417

(58) Field of Search ..... 166/277, 384, 166/380, 206, 207, 216, 217, 227, 238, 235, 242.2; 403/277, 278; 285/45, 47, 48, 53, 65, 106, 107, 109, 355, 417

(56) References Cited

U.S. PATENT DOCUMENTS

| | | | | |
|---|---|---|---|---|
| 1,678,640 | A | | 7/1928 | Hall |
| 2,226,804 | A | | 12/1940 | Carroll |
| 2,873,985 | A | | 2/1959 | Baldwin et al. |
| 3,766,991 | A | | 10/1973 | Brown |
| 3,857,450 | A | | 12/1974 | Guier |
| 3,913,687 | A | | 10/1975 | Gyongyosi et al. |
| 4,076,280 | A | | 2/1978 | Young |
| 4,449,596 | A | | 5/1984 | Boyadjieff |
| 4,625,796 | A | | 12/1986 | Boyadjieff |
| 4,754,807 | A | | 7/1988 | Lange |
| 4,771,829 | A | | 9/1988 | Sparlin |
| 4,793,422 | A | | 12/1988 | Krasnov |
| 4,813,493 | A | | 3/1989 | Shaw et al. |
| 4,878,546 | A | | 11/1989 | Shaw et al. |
| 4,985,975 | A | | 1/1991 | Austin et al. |
| 5,181,570 | A | | 1/1993 | Allwin et al. |
| 5,251,709 | A | | 10/1993 | Richardson |
| 5,332,049 | A | * | 7/1994 | Tew ..... 175/320 |
| 5,339,895 | A | | 8/1994 | Arterbury et al. |
| 5,388,651 | A | | 2/1995 | Berry |

(Continued)

FOREIGN PATENT DOCUMENTS

| | | |
|---|---|---|
| EP | 0 171 144 A1 | 2/1986 |
| EP | 0 659 975 | 6/1995 |
| WO | WO 9312323 | 6/1993 |
| WO | WO 97/17524 | 5/1997 |
| WO | WO 98/22690 | 5/1998 |
| WO | WO 98/32948 | 7/1998 |

*Primary Examiner*—David Bagnell
*Assistant Examiner*—Jennifer H Gay
(74) *Attorney, Agent, or Firm*—Moser, Patterson & Sheridan, L.L.P.

(57) ABSTRACT

A tubing connection arrangement that includes two expandable tubing sections is disclosed. In one embodiment, each of the tubing sections includes a filter screen sandwiched between inner expandable tubing and outer expandable tubing. On expansion of the tubing sections, the outer tubing provides resistance to radial expansion of the inner tubing in order to ensure that the integrity between the tubing sections is maintained. The filter screen of one of the tubing sections overlaps the filter screen of the other tubing section, and the outer expandable tubing of at least one of the tubing sections extends over the overlapping filter screens.

15 Claims, 1 Drawing Sheet

U.S. PATENT DOCUMENTS 5,474,334 A * 12/1995 Eppink ..... 285/184
5,787,980 A 8/1998 Sparlin et al.
5,855,242 A 1/1999 Johnson
5,901,789 A 5/1999 Donnelly et al.
5,924,745 A 7/1999 Campbell
5,984,568 A 11/1999 Lohbeck
6,012,522 A 1/2000 Donnelly
6,109,349 A 8/2000 Simone et al.
6,158,507 A 12/2000 Rouse et al.
6,273,634 B1 8/2001 Lohbeck
6,315,040 B1 11/2001 Donnelly
6,322,109 B1 11/2001 Campbell et al.
6,409,175 B1 6/2002 Evans et al.
6,543,816 B1 4/2003 Noel
6,622,797 B2 * 9/2003 Sivley, IV ..... 166/380
6,722,443 B1 * 4/2004 Metcalfe ..... 166/384
2002/0070031 A1 6/2002 Voll et al.
2002/0163192 A1 11/2002 Coulon et al.
2003/0075338 A1 * 4/2003 Sivley ..... 166/380
2004/0055759 A1 * 3/2004 Sivley ..... 166/384
2004/0069498 A1 * 4/2004 Simpson et al. ..... 166/380

* cited by examiner

CONNECTOR FOR EXPANDABLE WELL SCREEN

CROSS-REFERENCE TO RELATED APPLICATIONS

This application is a continuation of U.S. patent application Ser. No. 09/762,410, filed May 17, 2001, now U.S. Pat. No. 6,722,443, which is the National Stage of International Application No. PCT/GB99/02605, filed Aug. 9, 1999, which claims priority to Great Britain Application No. 9817246.3, filed on Aug. 8, 1998. Each of the aforementioned related patent applications is herein incorporated by reference in their entireties.

BACKGROUND OF THE INVENTION

1. Field of the Invention

This invention relates to a downhole connector, and in particular to an arrangement for ensuring the integrity of a sand screen or other filter medium at a connection between two lengths of expandable tubing utilized to support or form a sand screen or filter.

2. Description of the Related Art

In many well bores where a liquid, for example oil, passes from a surrounding formation into the well bore, the liquid will often carry entrained sand particles. If this sand is permitted to pass into the well bore, a number of problems may arise, including an increased likelihood of the well bore becoming blocked or restricted, and the sand may cause downhole tools to stick or jam, or wear prematurely. Accordingly, it is preferred that the sand particles are retained in the formation. This is achieved by providing screens or a filter around the casing or production tubing.

International Patent Application WO 97/17524 (Shell), the disclosure of which is incorporated herein by reference, describes a radially expandable assembly in which overlapping filter sheets are sandwiched between an inner expandable support tubing and an outer expandable protective tubing, the expandable tubing featuring large numbers of overlapping longitudinal slots. When an expander cone is forced through the assembly, the inner and outer tubing is expanded radially, the slots extending to form diamond-shaped openings. The initial degree of overlap between the screens is selected such that, although the screens move circumferentially relative to one another during expansion, the edges of the screens remain in overlapping relation. Such an arrangement can easily be constructed over sections of plain tubing or pipe. However, at the connections between tubing sections, where the inner tubing sections are coupled together, it is difficult to maintain a "sand-tight" joint.

It is among the objectives of embodiments of the present invention to provide a connector arrangement which obviates or mitigates this difficulty.

SUMMARY OF THE INVENTION

According to the present invention, there is provided a connector arrangement between the ends of two expandable tubing sections. Each expandable tubing section includes a filter screen sandwiched between an inner expandable tubing and an outer expandable tubing. The filter screen of one tubing section overlaps the filter screen of the other tubing section, and the outer expandable tubing of at least one of the tubing sections extends over the overlapping filter screens.

The invention also relates to expandable tubing sections which are adapted to be connected in this manner, to expandable tubing strings incorporating such connector arrangements, and to a method of connecting tubing sections.

On expansion of the tubing sections, the overlapping filter screens, restrained by the outer tubing, ensure the integrity of the filter between the tubing sections.

The outer expandable tubing of one tubing section may be arranged to overlap or to butt against the outer expandable tubing of the other tubing section.

Each filter screen includes a plurality of overlapping plates, sheets or membranes individually mounted to the respective inner expandable tubing by axially parallel connectors or fixings, such as screws, lugs or welds.

Preferably, the filter screens of each tubing section are initially radially spaced apart to facilitate make-up of the connector. However, on expansion, the resistance of the outer tubing to radial expansion of the inner tubing ensures that the outer filter screen is pressed into a sand-tight engagement with the inner filter screen. The desired relative positioning of the filter screens of the two tubing sections may be achieved by providing one inner tubing section having an end of slightly larger diameter than the other. In certain embodiments, the ends of each tubing section may be upset, that is, of greater diameter than the remainder of the tubing section, and the desired difference in diameter may be achieved by providing a slightly higher upset on one tubing section. Conveniently, the inner tubing sections will feature pin and box connections, and the upset on the box may be slightly higher than the pin. Of course the opposite arrangement may provided, that is, the pin upset being higher than the box.

The ends of one or both filter screens may be provided with means for preventing interference between the screen ends when the tubing sections are rotated relative to one another, as may be the case if the tubing sections are threaded to one another. The means may take the form of a sleeve of flexible or extendible material located internally and/or externally of the filter screens. The sleeve may be formed of flexible slotted tubing, plastics, rubber, wire mesh or wire composites.

According to another aspect of the present invention, there is provided a section of expandable tubing comprising a filter medium sandwiched between inner expandable tubing and outer expandable tubing, the filter medium comprising a plurality of circumferentially extending filter sheets, each sheet being coupled at one edge to one of the inner and outer tubing and having the opposite edge overlapping an adjacent sheet, and means for reducing the friction between at least one of the filter sheets and the filter sheets and the tubing.

In other aspects of the invention, friction reducing means may be provided on other parts or elements of a tubing section.

This aspect of the invention may be provided in combination with the first described aspect.

In use, the friction reducing means facilitates expansion of the tubing by facilitating relative circumferential movement of the filter sheets relative to one another and of the filter sheets relative to the tubing. The presence of such friction reducing means also reduces the likelihood of damage occurring to the relatively fragile filter sheets during expansion, as has been found to occur on occasion in tubing made in accordance with WO 97/17524.

Preferably, the friction reducing means is a low friction coating applied to the filter sheets, such as a PTFE-based material such as TEFLON™. In other embodiments, a friction-reducing lubricant, such as high temperature grease, may be provided. Alternatively, sheets of low friction material may be placed between the filter sheets and the tubing.

These and other aspects of the present invention will now be described, by way or example, with reference to the accompanying drawings, in which:

DETAILED DESCRIPTION OF THE PREFERRED EMBODIMENTS

Figure 1:
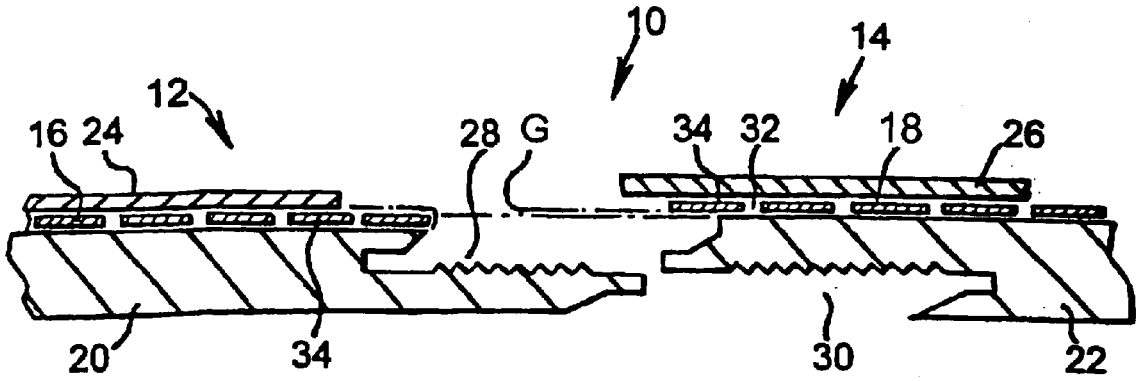
FIG. 1 is a schematic sectional view of part of a connector in accordance with a preferred embodiment of the present invention, with the connector parts shown separated.

The drawings illustrate part of a connector 10 in accordance with an embodiment of the present invention. The connector 10 is provided between the ends of two sections of expandable tubing 12, 14, each comprising filter plates 16, 18 sandwiched between inner expandable support tubing 20, 22 and outer expandable protective tubing 24, 26. Each section of expandable tubing 20, 22, 24, 26 defines a large number of longitudinal overlapping slots. The sections of inner or base expandable tubing 20, 22 are formed with co-operating pin and box connections 28, 30, to allow the tubing sections 12, 14 to be made up by relative rotation.

Figure 2:
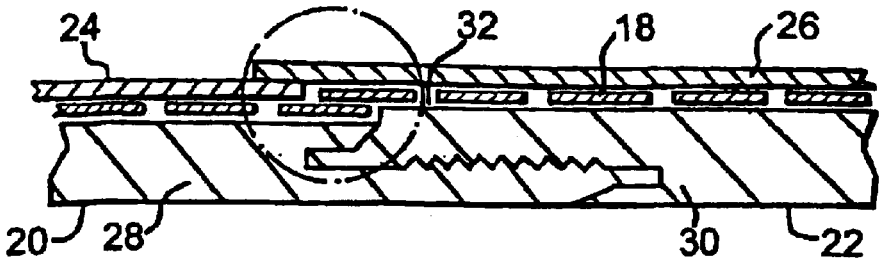
FIG. 2 is a schematic sectional view of the connector of FIG. 1, with the connector parts shown coupled together.

As is more clearly apparent from FIG. 2, the box connection 30 is upset from the pin 28. The filter plates 18 mounted around the box 30 extend beyond the end of the box outer surface 32 such that on making up the connection, the filter plates 18 overlap the filter plates 16 mounted on the pin 28. The outer tubing 24 on the pin 28 terminates short of the end of the filter plates 16 to accommodate the filter plate overlap, and the outer tubing 24 is similarly overlapped by the end of the outer tubing 26 on the box 30.

The overlapping filter plates 16, 18 are positioned such that there is a small radial gap G between the filter plates 16, 18, to allow the connection to be made up without snagging or galling of the opposing filter plates.

When the connection is expanded downhole by passing a cone through the connection, the outer tubing 24, 26 resists the expansion of the inner tubing 20, 22. This results in the outer tubing 24, 26 providing an inward radial force, which maintains the overlapping filter plates 16, 18 in engagement and effects a sand-tight seal.

To facilitate make-up and backing-off of the connection 10, the ends of the filter plates 16 are provided with an expandable make-up protection sleeve which prevents the overlapping plates on either the pin 28 or the box 30 from snagging on the opposing filter plates when the pin and box are rotated relative to one another.

To facilitate expansion of the tubing, the filter plates 16, 18 are provided with a coating 34 of a low-friction material, in this case a PTFE-based material such as TEFLON™. This coating facilitates relative movement of the plates 16, 18 and the tubing 20, 22, 24, 26, and minimizes the risk of tearing of the filter plates 16, 18 as the tubing sections are made up and expanded.

It will be clear to those of skill in the art that the above-described embodiment is merely exemplary of the present invention, and that various modifications and improvements may be made thereto without departing from the scope of the present invention.

What is claimed:

1. An expandable tubing assembly, comprising:

a first tubular having a connector end configured to mate with a corresponding connector end of a second tubular to form a connection; and an outer tubular coupled to the first tubular, the outer tubular substantially surrounding an external circumferential junction between the first and second tubulars when the first and second tubulars are connected to one another, wherein the connection is expandable and the outer tubular is adapted to resist radial expansion of the connection to ensure that integrity between the first and second tubulars is retained after expansion.

2. The expandable tubing assembly of claim 1, wherein the connector ends are a pin and a box.

3. The expandable tubing assembly of claim 1, wherein the connector ends are threaded.

4. The expandable tubing assembly of claim 1, wherein the outer tubular concentrically overlaps another outer tubular coupled to the second tubular.

5. The expandable tubing assembly of claim 4, further comprising respective filter screens disposed between the first and second tubulars and the outer tubulars.

6. The expandable tubing assembly of claim 5, wherein the filter screens concentrically overlap one another at the connection when the first and second tubulars are connected.

7. The expandable tubing assembly of claim 1, wherein the first and second tubulars are perforated.

8. The expandable tubing assembly of claim 1, wherein the outer tubular is perforated.

9. The expandable tubing assembly of claim 1, wherein the outer tubular and the first and second tubulars are perforated.

10. The expandable tubing assembly of claim 1, further comprising a filter screen disposed on an outside surface of the first and second tubulars.

11. A method of expanding a connection between first and second tubulars in a wellbore, comprising:

providing the connection having the first and second tubulars with mating ends connected to one another and an outer tubular coupled to the first tubular and substantially surrounding an external circumferential junction between the first and second tubulars; and passing an expander through the connection to expand the connection downhole, wherein the outer tubular resists radial expansion of the first and second tubulars to ensure that integrity between the first and second tubulars is retained after expansion.

12. The method of claim 11, wherein the expander is a cone.

13. The method of claim 11, further comprising providing another outer tubular coupled to the second tubular and respective filter screens sandwiched between the first and second tubulars and the outer tubulars.

14. The method of claim 13, wherein passing the expander through the connection results in the outer tubulars providing an inward radial force which maintains the filter screens in overlapping engagement at the connection.

15. The method of claim 11, wherein the connection is formed by threading the first and second tubular to one another.

* * * * *